United States Patent [19]

Tai

[11] Patent Number: 5,002,679

[45] Date of Patent: Mar. 26, 1991

[54] BLEACH PRODUCTS

[75] Inventor: Ho T. Tai, Lille, France

[73] Assignee: Lever Brothers Company, Division of Conopco, Inc., New York, N.Y.

[21] Appl. No.: 529,671

[22] Filed: May 25, 1990

Related U.S. Application Data

[63] Continuation of Ser. No. 300,762, Jan. 23, 1989, abandoned, which is a continuation of Ser. No. 53,505, May 15, 1987, abandoned, which is a continuation of Ser. No. 815,709, Dec. 20, 1985, abandoned.

[30] Foreign Application Priority Data

Apr. 27, 1984 [GB] United Kingdom ..... 8410826

[51] Int. Cl.[5] ..... C11D 3/395

[52] U.S. Cl. ..... 252/90; 252/94; 252/95; 252/99; 252/102; 252/174; 252/186.38

[58] Field of Search ..... 430/90, 94, 95, 99, 430/102, 174, 186.38

[56] References Cited

U.S. PATENT DOCUMENTS 4,412,934 11/1983 Chung et al. ..... 252/186.38

FOREIGN PATENT DOCUMENTS 0011502 5/1980 European Pat. Off. .
0018678 11/1980 European Pat. Off. .
0041821 12/1981 European Pat. Off. .
0070066 1/1983 European Pat. Off. .
0070067 1/1983 European Pat. Off. .
0095335 11/1983 European Pat. Off. .
0096566 12/1983 European Pat. Off. .
0098108 1/1984 European Pat. Off. .
0106634 4/1984 European Pat. Off. .
3021416 12/1928 United Kingdom .
395211 7/1933 United Kingdom .
476564 12/1937 United Kingdom .
1013014 12/1965 United Kingdom .
1197981 7/1970 United Kingdom .
1298454 12/1972 United Kingdom .
1321267 6/1973 United Kingdom .
1459973 12/1976 United Kingdom .
1492597 11/1977 United Kingdom .
1565907 4/1980 United Kingdom .
1573406 8/1980 United Kingdom .
1587650 4/1981 United Kingdom .
2069020 6/1983 United Kingdom .
2066309 10/1983 United Kingdom .

*Primary Examiner*—Hoa Van Le
*Attorney, Agent, or Firm*—Ronald A. Koatz

[57] ABSTRACT

The invention concerns a bleach product for use in the washing machine as an adjunct to a normal detergent powder or liquid. The product consists essentially of a particulate bleach compositon and which is substantially free of other detergent components and which is contained within a non-coated bag of sheet material having a porosity to air of 5,000 to 10,000 liters/$m^2$/s. The bleach composition comprises sodium perborate with an activator such as tetraacetyl ethylenediamine or sodium octanoyloxybenzene sulphonate. Preferably at least 25 mole percent of the perborate is in monohydrate form in order to provide reduced malodor development on short storage.

15 Claims, No Drawings

BLEACH PRODUCTS

This is a continuation application of Ser. No. 300,762, filed Jan. 23, 1989, now abandoned, which is a continuation of Ser. No. 053,505 filed May 15, 1987 now abandoned, which is in turn a continuation of Ser. No. 815,709, filed Dec. 20, 1985, now abandoned.

The present invention relates to an improved wash adjunct product in the form of a small closed bag, containing a powdered bleaching composition. The bag can be used to improve the bleaching of fabrics washed in a domestic or industrial washing machine. The product of the invention contains a bleaching powder including sodium perborate in combination with a so-called bleach activator, that is to say, an organic compound which can react at a relatively low temperature, for example 20 to 60° C., with the perborate to form an organic peracid.

GB 1 459 973 (Procter & Gamble) discloses an article in bag form for bleaching fabrics in the tumble-dryer. The article consists of a powdered bleaching composition within a closed flexible receptacle of material, such as foam, polyester or cotton cloth, having relatively large open pores. The bleaching composition may contain alkali metal perborates of any degree of hydration, used in combination with an activator, for example, tetraacetyl ethylene diamine (TAED) or 1,3,4,6-tetraacetyl glycouranil (TAGU). The pore size of the receptacle is larger than the particle size of the bleaching composition, so that during tumble-drying the powdered bleaching composition will be delivered through the pores of the receptacle onto the fabric load. It is thus difficult to prevent premature escape (dusting-out) of the bleaching composition during transport and storage, and expensive profile packaging may be required.

EP 18 678A (Unilever) describes a wash adjunct bleach product in bag form. A powdered bleach composition comprising a percompound, for example, an alkali metal perborate, and a bleach activator such as TAED, is contained within a closed water-insoluble but water-permeable bag of fibrous material provided with a protective water-impermeable coating which is removable in water at a temperature of 30° to 75° C., preferably 35° to 65° C. This bag is thus intended to release its contents only when the wash temperature exceeds this value, in order that catalase present on the soiled wash load should be destroyed, by heat, before the bleach composition enters the wash liquor; this is stated to be necessary in order to prevent deactivation of the perborate by the catalase. The bag material used should have a pore size such that, before the coating is applied, there is no appreciable dusting out of the bleach composition in the dry state; the coating, however, completely closes the pores of the bag material.

It has now surprisingly been discovered that sodium perborate and a bleach activator, packed in a bag of which the pores have not been closed with a coating, can be used effectively in washes at all temperatures without apparent catalase problems.

The present invention accordingly provides a wash adjunct product comprising a closed bag containing a particulate bleach composition consisting essentially of sodium perborate and an activator therefor, the bag being formed of sheet material having pores large enough to render it water-permeable but small enough to confine the particulate bleach composition within the bag.

Unlike the bag of the aforementioned EP 18 678A, the bag of the present invention does not have a coating which closes its pores so as to render it water-impermeable. Surprisingly, it has been found that a bag in accordance with the present invention can give better bleaching than as otherwise identical coated bag in accordance with the aforementioned EP 18 678A, when both are used at a temperature high enough to cause melting of the protective coating of the coated bag. The expected deactivation by catalase does not appear to take place. Furthermore, the bag of the present invention can also be used at lower temperatures, at which the coated bag of EP 18 678A would not deliver its contents at all.

In the bag of the invention, the particle size of the bleach composition and the pore size of the bag are matched so that the bleach composition cannot escape from the bag but yet can be efficiently leached out, in use, by the wash liquor. The average particle size of the composition is preferably at least 30 μm, more preferably at least 50 μm, and advantageously does not exceed 2000 μm. A range of 100 to 900 μm is especially preferred.

The bags used to form the products of the invention are of the type which remains closed during the washing and bleaching process in the washing machine. They are formed from water-insoluble sheet material which may for example, be in the form of paper or of woven, nonwoven or knitted fabric which should, of course, have sufficient wet strength to survive the washing process without disintegrating. The pore size and porosity of the bag material are very important. The pores must be large enough to allow rapid entry of water into the bag to leach out the contents, but also sufficiently small that there is no appreciable leakage of the bleach composition out of the bag in the dry state.

The porosity to air of the bag material is preferably at least 5000 liters/$m^2$/s, more preferably from 7000 to 10000 liters/$m^2$/s.

Also of major importance is the porosity of the bag material to the powder contained in the bag. As stated previously, the bag porosity should be matched to the powder particle size such that the powder is substantially wholly confined within the bag.

A simple method (the shaking test) was used to estimate the porosity to powder of various bag materials. This involved determining the percentage loss of a standard particulate material after shaking for 5 minutes or 30 minutes. The standard particulate material chosen consisted of spherical glass ballotini (ex Potters) of sieve fraction 90–106 μm, chosen to be reasonably representative of detergent powder fines (particles smaller than 150 μm) yet to show no attrition under the conditions of the test. The bag materials under test were formed into sachets of internal dimensions 4 cm×4 cm, filled with 5 g of the ballotini, and closed by heat-sealing or with double-sided tape. Four sachets at a time were placed on a 20 cm diameter sieve grid of a large mesh size (2.8 mm) that would not impede the passage of any ballotini released during the test, the sieve grid being fitted over a base pan. The sieve was then covered and placed on a Russell Laboratory Finex (Trade Mark) Model 8552 sieving machine, and an intermediate continuous shaking setting (5 on the scale) was selected. The sachet weights were monitored over a total period of 30 minutes.

Some results of this test are shown in Table 1, which (*) denotes a Trade Mark, duplicate results being shown where these were carried out. Two materials of well-defined pore size (nylon meshes having 118 μm square and 100 μm square apertures) were included in an attempt to relate porosity to pore size: these are samples (n) and (p).

For the purpose of the present invention, bag materials can be classified on the basis of this test as follows:

| | % weight loss after | |
|---|---|---|
| | 5 min | 30 min |
| Highly acceptable | <1 | <5 |
| Acceptable | from 1 to 10 | from 5 to 20 |
| Unacceptable | >10 | >20 |

Thus of the materials listed in Table 1, samples (a), (b), (1) and (m) are highly acceptable; samples (c), (g) and (i) are acceptable; and samples (d), (e), (f), (h), (j) and (k) are unacceptable.

It must also be remembered that the porosity should be sufficient to allow adequate water permeability, otherwise the bag will not deliver its contents sufficiently quickly. Thus materials of very low porposity, such as samples (1) and (m), may in practice be less preferred than ones of slightly higher porosity, such as samples (a), (b) or (i).

TABLE 1

| Bag material | Trade name and source | % weight loss after 5 min | % weight loss after 30 min |
|---|---|---|---|
| (a) Polyester nonwoven fabric | Intissel* 3687 (France) | 0.3, 0.1 | 2.4, 0.9 |
| (b) Spunlaced polyester nonwoven fabric | Sontara* 8000 (Du Pont, U.S.A.) | 0.5, 0.1 | 1.5, 0.4 |
| (c) Wet strength paper, 23 g/m² | Springtex* 23 (Crompton, U.K.) | 3.0, 1.3 | 19.1, 15.7 |
| (d) Polyester/viscose wet laid nonwoven fabric, 16.5 g/m² | Crompton* 829 (Crompton, U.K.) | 100 | — |
| (e) Polyester/viscose wet laid nonwoven fabric, 16.5 g/m² | Crompton* 684 (Crompton, U.K.) | 100 | — |
| (f) Polyester/viscose wet laid nonwoven fabric, 16.5 g/m² | Crompton* 685 (Crompton, U.K.) | 100 | — |
| (g) Wet strength paper | Sausage casing (Crompton, U.K.) | 1.7 | 10.7 |
| (h) Polyester/viscose wet laid nonwoven fabric, 16.5 g/m² | Crompton* 784 (Crompton, U.K.) | 33.4 | 100 |
| (i) Polyester/viscose wet laid nonwoven fabric, 26 g/m² | Crompton* 784 | 1.2, 2.9 | 6.0, 15.6 |
| **Bag material** | **Trade name and source** | **% weight loss after 15 min** | **% weight loss after 30 min** |
| (j) Polyester nonwoven fabric, 40 g/m² | FC 40 (Bonded Fibre Fabrics, U.K.) | 94.5 | 98.2 |
| (k) Polyester nonwoven fabric, 50 g/m² | FC 50 (Bonded Fibre Fabrics, U.K.) | 8.8, 8.6 | 63.0, 42.0 |
| (l) Polyester nonwoven fabric, 80 g/m² | FC 80 (Bonded Fibre Fabrics, U.K.) | 0.1 | 1.1 |
| (m) Polyester nonwoven fabric, 110 g/m² | FC 110 (Bonded Fibre Fabrics, U.K.) | 0.01 | 0.04 |
| (n) Nylon monofilament mesh, mesh size 118 μm square | Nybolt* 11 XXX-118 (Swiss Silk Bolting Cloth Mfg Co., Switzerland) | 100 | — |
| (p) Nylon monofilament mesh, mesh size 100 μm square | Nybolt* Din 60-100 (Swiss Silk Bolting Cloth Mfg Co., Switzerland) | 0 | 0 |

As may be inferred from these various considerations, suitable bag materials include water-permeable paper or nonwoven fabrics of high wet strength. The fibres used for the sheet materials may be of natural or synthetic origin and may be used alone or in admixture, for example, polyamide, polyester, polyacrylic, cellulose acetate, polyethylene, polyvinyl chloride, polypropylene or cellulosic fibres. It is preferred to include at least a proportion of thermoplastic fibres, in order to increase the resistance to chemical attack by the bleaching agent, and also to enable the bags to be closed by heat-sealing.

The bag materials may be treated with a binding agent provided that this does not close its pore structure to an extent that it is rendered impermeable to water. In this case, the discussion of porosity above will relate to the material plus the binding agent.

Especially preferred bag materials are single-layer or multilayer nonwoven fabrics and wet-strength papers having base weights in the range of from 15 to 250 g/m², especially from about 20 to 150 g/m². The bag materials may advantageously consist of a mixture of polyester and cellulosic fibres.

The bags are conveniently square or rectangular in shape, although any shape may be used. The size of the bag will of course depend on the dosage of bleach composition it contains A rectangular bag intended for a single domestic washload of typical size, and containing perhaps from 10 to 40 g of bleach composition, may conveniently have dimensions of 60-150 mm×60-150 mm, especially 80-120 mm×80-120 mm.

According to a preferred embodiment of the invention, at least 25 mole per cent of the sodium perborate contained in the bag of the present invention is in monohydrate form. Advantageously substantially all of the sodium perborate may be in monohydrate form. Sodium perborate in monohydrate form has the additional advantages of greater water-solubility, especially at low temperatures, and of lower molecular weight which allows a smaller dose to be used to deliver the same level of available oxygen, so that a smaller and lighter bag product can be produced.

A further, unexpected benefit was found to accrue from the use of sodium perborate at least partially in monohydrate form, when used in conjunction with an activator which on reaction with the perborate generates a percarboxylic acid of which the corresponding carboxylic acid is malodorous. This benefit, of reduced development of malodour on short storage, was first observed with activators that generate peracetic acid; with bags containing tetracetyl ethylenediamine (TAED) and sodium perborate tetrahydrate, for example, it was found that because the bag contents were open to the atmosphere through the porous bag walls an unpleasant odour could develop even after periods of storage, for example, one week, that were so short that no measurable decomposition of either TAED or perborate could be detected. This problem does not occur when fully formulated detergent compositions containing TAED and sodium perborate tetrahydrate are packed in sachets, but is apparently peculiar to sachets intended for use as wash adjunct products and containing only minor proportions of ingredients other than the bleaching agents.

Surprisingly, it was found that this problem could be solved by replacing sodium perborate tetrahydrate, at least in part, by the monohydrate. Further experiments indicated that the benefit of reduced malodour on short storage could be observed with other bleach activators whose ultimate decomposition products were malodorous carboxylic acids.

Detergent compositions containing sodium perborate monohydrate have been disclosed in GB 1 573 406 (Unilever), EP 98 108A (Unilever) and GB 1 321 627 (Henkel). GB 1 573 406 discloses detergent compositions containing a bleach system consisting of sodium perborate monohydrate and the activator tetracetyl ethylenediamine (TAED) in granular form, together with detergent-active compounds, detergency builders, enzymes, fluorescers and other usual constituents. As compared with similar compositions containing sodium perborate tetrahydrate, these compositions exhibit superior storage stability over a four-week period, as illustrated by reduced TAED loss, reduced perborate loss, reduced fluorescer loss and improved enzyme stability.

The particular hydrate of sodium perborate used in the Examples of the aforementioned EP 18 678A (Unilever) is not stated, but is known by the present inventor, also the inventor of EP 18 678A, to have been the tetrahydrate which was the form of sodium perborate normally used in 1979, the priority date of EP 18 678A.

The activator used in the bag of the present invention is a material that reacts with the perborate, in the environment of the wash liquor, to yield a percarboxylic acid. This is the active bleaching species and is decomposed by the bleaching reaction to give the corresponding carboxylic acid which may be a malodorous material. In a preferred embodiment of the invention the peracid generated is peracetic acid, the decomposition product of which (acetic acid) has an unpleasant vinegary smell.

Examples of bleach activators that react with sodium perborate to yield peracetic acid include the following:

(a) sugar esters, for example, glucose pentaacetate and xylose tetraacetate;

(b) esters of phenols, for example, sodium acetoxybenzene sulphonate;

(c) N-acylated amines and amides, for example, tetraacetyl ethylenediamine, tetraacetyl methylenediamine and tetraacetyl glycouranil;

(d) acetyl oximes, for example, dimethylglyoxime acetate.

An example of a bleach activator that does not generate peracetic acid yet can still give malodour problems on short storage when used with sodium perborate tetrahydrate in a bag product is sodium octanoyloxybenzene sulphonate.

The preferred bleach activator for use in the bag of the present invention is tetracetyl ethylenediamine (TAED).

Preferably the weight ratio of sodium perborate to activator is within the range of from 35:1 to 1:5, more preferably from 20:1 to 1:5 and advantageously within the range of from 3:1 to 0.8:1. In detergent powders it is normal to include a large excess of per-compound to allow for mechanical loss and deactivation by catalase, but that has been found not to be essential with the bag of the present invention: the elimination of mechanical losses by the use of a bag product is to be expected, but the lack of deactivation by catalase is more surprising. Use of an excess of activator may be useful if the bag is to supplement a detergent powder containing perborate but no activator.

The activator, for example, TAED, may conveniently be used in the form of granules obtaining by granulating a suitable inorganic or organic carrier material, for example, inorganic phosphate, nonionic surfactant, fatty acid, hardened tallow, paraffin wax or sodium carboxymethyl cellulose, with activator particles. The particle size of the composite granules may conveniently lie within the 200 to 2000 μm range, the particle size of the activator within the granules being advantageously less than 150 μm and preferably less than 100 μm.

The bag of the invention conveniently contains an amount of sodium perborate suitable for an average-sized single wash operation, together with an appropriate amount of activator. Alternatively, smaller bags can each contain an appropriate amount for 1 kilogram of soiled fabrics, and can be used in multiples as required. In a bag intended for a single domestic washload, the amount of perborate is suitably within the range of from 0.5 to 30 g, preferably from 1 to 15 g. For use in a commercial or industrial laundry, larger doses will in general be appropriate.

The preferred quantities of activator can readily be inferred from the preferred perborate to activator ratios given above.

If desired, there may be included in the bag of the invention a stabiliser for the bleach system, for example, ethylene diamine tetramethylene phosphonate or diethylene triamine pentamethylene phosphonate. The stabiliser can be used in acid or salt form, preferably in calcium, magnesium, zinc or aluminium complex form, as described in GB 2 048 930 (Unilever). The stabiliser may advantageously be present in an amount of from 0.5 to 5% by weight, more preferably from 1.5 to 2.5% by weight, based on the total weight of sodium perborate, activator and stabiliser. Use of a stabiliser is not, however, essential.

The bag of the present invention does not contain all the ingredients of a fully formulated detergent composition. It is intended not as a replacement for a conventional detergent composition but for use as a bleach adjunct together with a conventional bleaching or non-bleaching detergent composition. The essential components of the bag contents are sodium perborate and an activator: this combination of ingredients represents a complete bleaching system, effective at low or high wash temperatures, and the bag can then be used as an adjunct or supplement when washing with powders containing no bleach system or containing one ineffective at low temperatures, or when extra bleach efficiency is required, for example, when dealing with an especially heavily stained fabric load.

The bag may, however, contain minor amounts of perfume, bleach stabiliser or other suitable additives. If desired, too, minor amounts of other adjunct materials, or particular ingredients used in detergent compositions, may be included to give specific benefits. Furthermore, as previously indicated, the bleach activator may of course be in the form of granules which contain quite substantial amounts of carrier material or binding agent.

The invention will now be illustrated by the following non-limiting Examples.

EXAMPLE 1

A bag product in accordance with the invention was prepared from a porous nonwoven fabric, of average pore size 70μm, consisting of 40% polyester fibres and 60% viscose fibres. The fabric was coated on one side (the inside of the bag) with a polyamide heat-seal finish. The bag was rectangular, had dimensions of 100×110 mm, and was closed by heat-sealing. Its contents were as follows:

| | |
|---|---|
| Sodium perborate monohydrate (ex Degussa, particle size substantially 100–700 μm) | 10.66 g |
| TAED granules (300–2000 μm) (65.3% TAED, 32% phosphates, 2.7% water) | 15.32 g |

EXAMPLE 2

A bag product of the invention, similar to that of Example 1 but also containing a bleach stabiliser, was prepared from a multilayer nonwoven fabric having a base weight of about 100 g/m$^2$ and consisting of 40% by weight of acrylic fibres and 60% by weight of mixed polyester/cellulosic fibres (80% polyester, 20% cellulose). The bag was rectangular, had dimensions of approximately 100×80 mm, and was closed by heat-sealing. The bag contained the following ingredients:

| | |
|---|---|
| Sodium perborate monohydrate (particle size 50–600 μm ex Air Liquide) | 13 g |
| TAED granules (300–2000 μm) (65% TAED, 35% inorganic phosphate) | 12 g |
| Ethylene diamine tetramethylene phosphonate | 0.5 g |

EXAMPLE 3

The bleach performance of the bag product of Example 2 was compared with that of a coated bag in accordance with the aforementioned EP 18 678A (Unilever). The comparison bag was coated with a paraffin wax having a melting point of 40°–42° C., but was otherwise identical to the bag described above.

Comparative washing tests were carried out in the presence of catalase using fabric loads consisting of test cloths stained with tea or with wine. Bleaching efficiency was compared by means of reflectance measurements. Each wash was carried out using a Vedette (Trade Mark) 494 washing machine set to the 45° C. wash cycle. In each test a detergent powder, in the recommended dosage of 197 g, was added to the washing machine in the normal manner; the powder contained the usual detergent ingredients, fillers, enzymes etc. but no bleach ingredients. The bleach bags were placed with the fabric loads at the beginning of the wash cycle.

The results were as follows:

| | Reflectance | |
|---|---|---|
| | Coated bag | Uncoated bag |
| Tea-stained cloth | 43 | 51 |
| Wine-stained cloth | 61 | 61 |

It will be seen that although the results on the wine-stained cloth were identical, the uncoated bag gave a much better result (8 reflectance units) on the tea-stained cloth.

EXAMPLE 4

The procedure of Example 3 was repeated using the higher wash temperature of 60° C. This time the comparison bag was coated with a paraffin wax having a melting point of 55° C. The results were as follows:

| | Reflectance | |
|---|---|---|
| | Coated bag | Uncoated bag |
| Tea-stained cloth | 60.5 | 63 |
| Wine-stained cloth | 70 | 72 |

It will be seen that at this temperature the uncoated bag gave better results on both types of stain.

EXAMPLE 5

In this Example the low-temperature bleaching performance of a bag according to the invention, used in conjunction with a base powder containing no bleach ingredients, was compared with that of a base powder additionally containing the same levels of perborate and TAED. The tests were carried out in the Vedette 494 washing machine using the 30° C. wash cycle, in the presence of catalase, using tea-stained or wine-stained test cloths.

In each test 203.5 g of base powder (with filler) was used. In the comparative test the powder also contained 18 g of sodium perborate monohydrate and 12 g of TAED granules (65% TAED, 35% inorganic phosphate) and 0.5 g of the stabiliser used in Example 2. In the test according to the invention the powder contained none of these ingredients, and a bag similar to that of Example 2, but containing 18 g of perborate monohydrate instead of 13 g, was placed with the fabrics before the start of the wash cycle.

The results were as follows:

| | Without bag (bleach in powder) | Bleach in bag |
|---|---|---|
| Tea-stained cloth | 42.7 | 50.6 |
| Wine-stained cloth | 59.2 | 63.9 |

On both types of stain the bleaching was substantially more efficient at this temperature when the bleach ingredients were contained in a bag according to the invention.

EXAMPLE 6

A bag similar to that of Example 5 was prepared containing sodium perborate tetrahydrate instead of sodium perborate monohydrate. To give the same available oxygen level a dosage of 27 g, as compared with 18 g of monohydrate, was required.

The bleaching performance of this bag was compared with that of the bag of Example 5 using the procedure of that Example. The results were as follows:

| | Tetrahydrate | Monohydrate |
|---|---|---|
| Tea-stained cloth | 49.6 | 50.6 |
| Wine-stained cloth | 62.8 | 63.9 |

The tetrahydrate gave marginally worse results than the monohydrate but comparison with the results of Example 5 shows that both bags were better than the bleach-containing powder.

EXAMPLE 7

Using a Brandt (Trade Mark) washing machine set to a 60° C. cycle, the bag of Example 2, used with a bleach-free base powder, was compared with a typical commercial product containing perborate tetrahydrate (28 g), TAED granules (4.7 g) and the stabiliser used in Example 2 (0.5 g). 200.8 g of base powder (non-bleach) was used in each case. The comparison was carried out in the presence of catalase. The results were as follows:

| | Tetrahydrate in powder | Monohydrate in bag |
|---|---|---|
| Tea-stained cloth | 49.7 | 54.0 |
| Wine-stained cloth | 63.2 | 67.5 |

EXAMPLE 8

A first set of bags as described in Example 1 was prepared. A second set of bags was also prepared in which each contained 16.42 g of sodium perborate tetrahydrate (ex Degussa, particle size substantially 100–700 μm) instead of the monohydrate, but were otherwise identical: the larger amount of tetrahydrate was required to give the same level of available oxygen.

The development of malodour by the two types of bag after 1, 2 and 4 weeks' storage under three different sets of conditions was compared by means of a "triad test" involving the sensory perception of smell by the members of a panel. The samples (bags) were grouped in threes or "triads" in which two were the same and the other different, i.e. either one contained monohydrate and two contained tetrahydrate, or vice versa. Each triad was presented to a panellist who was required to attempt to indentify the "odd" sample that was different from the other two. The panellist was next asked:

(i) whether he preferred the smell of the "odd" sample of that of the other two;

(ii) whether he found the smell of the "odd" sample stronger or weaker than that of the other two, and (iii) whether he found the smell of the "odd" sample pleasant, unpleasant or neutral.

Only the answers of those panellists who had correctly identified the "odd" sample were analysed further.

The order of presentation of the samples comprising the triads to the panellists was randomised, each triad being assessed by ten panellists.

The triad test is described in the Manual on Sensory Testing Methods, ASTM STP 434. Using the "chi-square" statistical test it can be shown that when ten panellists are used, seven out of ten correct indentifications are required for significance at the 95% confidence level.

Each bag was stored in a closed 900 g glass bottle at one of three different temperatures.

The results are set out in the following Tables, in which "X" denotes the first set of bags and "Y" the second set.

Table 2 shows the number of correct identifications out of 10 for each triad after 1-week, 2-week and 4-week storage periods.

TABLE 2

| Triad | Temperature (°C.) | Number of correct identifications out of 10 after 1 week | 2 weeks | 4 weeks |
|---|---|---|---|---|
| A (XXY) | 37 | 10 | 10 | 10 |
| B (XYY) | 37 | 7 | 10 | (3) |
| C (XXY) | 28 | 7 | 10 | 9 |
| D (XYY) | 28 | 9 | 7 | 9 |
| E (XXY) | 20 | 8 | 10 | 9 |
| F (XYY) | 20 | 7 | 8 | 10 |

The bracketed result was too low for significance.

It will be seen that the panellists were readily able to distinguish the two types of bag on a smell basis, ever after a week.

Further analysis of the significant results is given in Tables 3 to 8, which show the responses to the three questions above by those panellists who had correctly identified the "odd" sample. It will be seen that an overwhelming majority of panellists considered the Y bags to be more strongly smelling than the X bags, after all three storage periods. The high percentage of panellists who found the smell of the Y bags unpleasant but the smell of the X bags neutral will also be noted.

Table 9 is a summary of these results over all temperatures and storage times.

TABLE 3

| | Triad A (37° C., XXY) 1 week | 2 weeks | 4 weeks |
|---|---|---|---|
| Number of correct identifications out of 10 | 10 | 10 | 10 |
| % of these who preferred "odd" one | — | — | — |
| % of these who preferred other two | 100 | 100 | 100 |
| % of these who found "odd" one stronger | 100 | 100 | 100 |
| % of these who found "odd" one weaker | — | — | — |
| % of these who found "odd" one pleasant | — | — | — |
| % of these who found "odd" one unpleasant | 100 | 100 | 70 |
| % of these who found "odd" one neutral | — | — | 30 |

TABLE 4

| | Triad B (37° C., XYY) 1 week | 2 weeks |
|---|---|---|
| Number of correct identifications out of 10 | 7 | 10 |
| % of these who preferred "odd" one | 71 | 100 |
| % of these who preferred other two | 29 | — |
| % of these who found "odd" one stronger | — | — |
| % of these who found "odd" one weaker | 100 | 100 |

TABLE 4-continued

| Triad B (37° C., XYY) | 1 week | 2 weeks |
|---|---|---|
| % of these who found "odd" one pleasant | — | — |
| % of these who found "odd" one unpleasant | 29 | 20 |
| % of these who found "odd" one neutral | 71 | 80 |

TABLE 5

| Triad C (28° C., XXY) | 1 week | 2 weeks | 4 weeks |
|---|---|---|---|
| Number of correct identifications out of 10 | 7 | 10 | 9 |
| % of these who preferred "odd" one | — | — | — |
| % of these who preferred other two | 100 | 100 | 100 |
| % of these who found "odd" one stronger | 71 | 100 | 100 |
| % of these who found "odd" one weaker | 29 | — | — |
| % of these who found "odd" one pleasant | — | — | — |
| % of these who found "odd" one unpleasant | 86 | 100 | 70 |
| % of these who found "odd" one neutral | 14 | — | — |

TABLE 6

| Triad D (28° C., XYY) | 1 week | 2 weeks | 4 weeks |
|---|---|---|---|
| Number of correct identifications out of 10 | 9 | 7 | 9 |
| % of these who preferred "odd" one | 100 | 86 | 89 |
| % of these who preferred other two | — | 14 | 11 |
| % of these who found "odd" one stronger | 11 | 14 | — |
| % of these who found "odd" one weaker | 89 | 86 | 100 |
| % of these who found "odd" one pleasant | 11 | — | — |
| % of these who found "odd" one unpleasant | 11 | 43 | 11 |
| % of these who found "odd" one neutral | 78 | 57 | 89 |

TABLE 7

| Triad E (20° C., XXY) | 1 week | 2 weeks | 4 weeks |
|---|---|---|---|
| Number of correct identification out of 10 | 8 | 10 | 9 |
| % of these who preferred "odd" one | — | — | 11 |
| % of these who preferred other two | 100 | 100 | 89 |
| % of these who found "odd" one stronger | 100 | 100 | 89 |
| % of these who found "odd" one weaker | — | — | 11 |
| % of these who found "odd" one pleasant | — | — | — |
| % of these who found "odd" one unpleasant | 100 | 80 | 89 |
| % of these who found "odd" one neutral | — | 20 | 11 |

TABLE 8

| Triad F (20° C., XYY) | 1 week | 2 weeks | 4 weeks |
|---|---|---|---|
| Number of correct identification out of 10 | 7 | 8 | 10 |
| % of these who preferred "odd" one | 100 | 100 | 90 |
| % of these who preferred other two | — | — | 10 |
| % of these who found "odd" one stronger | — | — | — |
| % of these who found "odd" one weaker | 100 | 100 | 100 |
| % of these who found "odd" one pleasant | 14 | 12 | 10 |
| % of these who found "odd" one unpleasant | 14 | 12 | 30 |
| % of these who found "odd" one neutral | 72 | 76 | 60 |

TABLE 9

| | Odd sale in triad | |
|---|---|---|
| | Y | X |
| % who detect "odd" sample | 83 out of 90 = 92% | 70 out of 90 = 78% |
| % of those who prefer X | 82 out of 83 = 99% | 65 out of 70 = 93% |
| % of those who find the "odd" sample unpleasant | 76 out of 83 = 92% | — |
| % of those who find the "odd" sample neutral | — | 51 out of 70 = 73% |
| % of those who find Y stronger than X | 80 out of 83 = 96% | — |
| % of those who find X weaker than Y | — | 68 out of 70 = 97% |

The contents of the bags were analyzed after 1, 2 and 4 weeks for TAED decomposition and perborate decomposition. The results on TAED loss are shown in Table 10.

TABLE 10

| Temperature (° C.) | TAED (g) remaining after 1 week | 2 weeks | 4 weeks |
|---|---|---|---|
| | (i) Bags (X) (monohydrate) | | |
| 37 | 10.4 | 9.6 | 9.4 |
| 28 | 10.1 | 9.8 | 10.3 |
| 20 | 10.8 | 10.1 | 10.1 |
| | (ii) Bags (Y) (tetrahydrate) | | |
| 37 | 10.3 | 9.5 | 10.7 |
| 28 | 9.1 | 10.0 | 10.2 |
| 20 | 11.2 | 10.8 | 9.9 |

These results show that there was no significant TAED loss, and no significant difference between the bags containing perborate monohydrate and the bags containing perborate tetrahydrate.

The results on perborate loss were as shown in Table 11: for ease of comparison between monohydrate and tetrahydrate these are shown as percentages.

TABLE 11

| Temperature (° C.) | % perborate remaining after 1 week | 2 weeks | 4 weeks |
|---|---|---|---|
| | (i) Bags (X) (monohydrate) | | |
| 37 | 98 | 105 | 98 |
| 28 | 95 | 98 | 100 |
| 20 | 100 | 98 | 100 |
| | (ii) Bags (Y) (tetrahydrate | | |
| 37 | 100 | 104 | 96 |
| 28 | 101 | 100 | 96 |

TABLE 11-continued

| Temperature (° C.) | % perborate remaining after 1 week | 2 weeks | 4 weeks |
|---|---|---|---|
| 20 | 96 | 98 | 96 |

Although in general slight losses of perborate occurred, there was no significant difference between the two sets of bags.

Thus the reduced malodour development in the bags containing the monohydrate cannot simply be attributed to reduced decomposition of TAED and perborate as described in GB 1 573 406 (Unilever).

The TAED granules used in Example 1 contained phosphate binders. Rapid screening of bags containing TAED granules containing other binding agents (tallow alcohol ethoxylate, hardened tallow fatty acid, hardened tallow, paraffin wax) indicated a similar difference between perborate monohydrate and tetrahydrate.

EXAMPLE 9

In Example 8 bags (X) containing sodium perborate of which 100% was in monohydrate form were compared with bags (Y) containing sodium perborate of which 100% was in tetrahydrate form. In the following experiment triad test methodology was used to compare bags containing various mixtures of monohydrate and tetrahydrate with bags containing only tetrahydrate.

The bags used in the test were of the same material and dimensions as that of Example 1, and each contained 15.32 g of the TAED granules used in Example 1. The sodium perborate contents of the bags, chosen to give an identical available oxygen level for every bag, were as shown in Table 12.

TABLE 12

| Bags | Monohydrate (g) | Tetrahydrate (g) | Mole % of monohydrate |
|---|---|---|---|
| G | 2.67 | 12.32 | 25 |
| H | 5.33 | 8.21 | 50 |
| J | 8.00 | 4.11 | 75 |

The results of the triad test after 1 week's storage at 37° C. are shown in Table 13. It will be seen that 25 mole per cent of monohydrate was sufficient to give a significant reduction in malodour development after 1 week's storage at 37° C.

TABLE 13

| | Triad GGH | HHY | JJY |
|---|---|---|---|
| Number of correct identifications out of 10 | 8 | 10 | 10 |
| % of these who preferred Y | 0 | 10 | 0 |
| % of these who preferred other two | 100 | 90 | 100 |
| % of these who found Y stronger | 100 | 100 | 100 |
| % of these who found Y weaker | 0 | 0 | 0 |
| % of these who found Y pleasant | 0 | 0 | 0 |
| % of these who found Y unpleasant | 80 | 90 | 100 |
| % of these who found Y neutral | 20 | 10 | 0 |

COMPARATIVE EXAMPLE

The bags tested in Examples 8 and 9 were intended for use as wash adjunct products, and contained only TAED and perborate. The following comparative experiment was carried out in order to determine whether a similar difference between perborate monohydrate and perborate tetrahydrate could be detected in fully formulated detergent powders packed in sachets.

A detergent base powder was prepared containing

| | |
|---|---|
| 16.5% | active detergent |
| 45.2% | builder |
| 38.3% | other components |

A first set of bags (P), of size and material as described in Example 1, each contained 30 g of a powder composed as follows:

| | |
|---|---|
| Base powder | 25.3 g |
| Sodium perborate monohydrate | 2.4 g |
| TAED granules (as in Example 1) | 1.0 g |
| Anhydrous sodium sulphate | 1.3 g |

A second set of bags (Q) each contained 30 g of a powder composed as follows:

| | |
|---|---|
| Base powder | 25.3 g |
| Sodium perborate tetrahydrate | 3.7 g |
| TAED granules | 1.0 g |

After 1 week's storage, the bags of the two sets were grouped in threes and subjected to the triad test as described in Example 8. The results were as shown in Table 14.

TABLE 14

| Triad | Temperature (°C.) | Number of correct identifications out of 10 after 1 week |
|---|---|---|
| K (PPQ) | 37 | 4 |
| L (PQQ) | 37 | 4 |
| M (PPQ) | 28 | 3 |
| N (PQQ) | 28 | 1 |

It will be seen that in all cases the number of correct identifications was below the 7 out of 10 level required for significance. Thus after 1 week's storage there was no significant difference in smell between the two sets of bags; the reduced development of malodour according to the invention is observed only in the adjunct type of product.

EXAMPLE 10

A further sensory test was carried out on bags as described in Example 1 to determine the relative humidity conditions under which malodour development was most pronounced. After 1 week's storage at 28° C. under various conditions of relative humidity, the bags were assessed by two trained panellists under "double blind" conditions, that is, neither the presenter nor the panellists knew which sample was which. The panellists were asked to say:

(i) whether the X or Y bag had the stronger smell, and (ii) whether the smell of the bag having the stronger smell was strong or weak.

The replies to question (i) are summarised in Table 15, from which it may be seen that the monohydrate-containing bags X were never found to be stronger-smelling.

TABLE 15

| Relative humidity (%) | Stronger smelling bag after storage for | | |
|---|---|---|---|
| | 1 week | 2 weeks | 3 weeks |
| 12 | Y | Y | Y |
| 32 | Y | Y | Y |
| 52 | Y | Y | Y |
| 75 | no difference | no difference | Y |
| 85 | " | " | Y |
| 96 | " | " | Y |

Table 16 shows the answers to question (ii) on the bags Y.

TABLE 16

| Relative humidity (%) | Intensity of malodour after storage for | | |
|---|---|---|---|
| | 1 week | 2 weeks | 3 weeks |
| 12 | Strong | Strong | Strong |
| 32 | " | " | " |
| 52 | " | " | " |
| 75 | — | — | Weak |
| 85 | — | — | Weak |
| 96 | — | — | Weak |

These results show that, surprisingly, the development of malodour is most marked under conditions of low relative humidity.

EXAMPLE 11

A further triad test was carried out using bags containing sodium perborate (monohydrate or tetrahydrate) with a different activator, sodium octanoyloxybenzene sulphonate. In each triad the "odd" sample contained the tetrahydrate. The results are shown in Table 17.

TABLE 17

| | |
|---|---|
| Number out of 10 detecting "odd" sample correctly | 7 |
| % of these preferring mono | 100 |
| % of these finding smell of "odd" sample (tetra) unpleasant | 86 |
| % of these finding smell of "odd" sample (tetra) stronger than that of mono | 100 |

These results show that the malodour reduction benefit obtained by using sodium perborate monohydrate is not restricted to activators that generate peracetic acid.

I claim:

1. A wash adjunct product consisting essentially of a particulate bleach composition substantially free of other detergent components contained within a closed, non-coated bag of sheet material having a porosity to air of 5,000 to 10,000 liters/m$^2$/s, it water permeable, said bleach composition consisting essentially of at least 0.5 grams of sodium perborate at least 25 mole percent of which is in monohydrate form and an activator therefor which on reaction generates a percarboxylic acid of which the corresponding carboxylic acid is malodorous, the weight ratio of the sodium perborate and activator being within the range of 35:1 to 1:5.

2. A product as claimed in claim 1, characterised in that the bleaching composition has an average particle size of at least 30 μm.

3. A product as claimed in claim 2, characterised in that the bleaching composition has an average particle size within the range of from 50 to 2000 μm.

4. A product as claimed in claim 3, characterised in that the bleaching composition has an average particle size within the range of from 100 to 900 μm.

5. A product as claimed in claim 1, characterized in that the bag is formed of a paper or nonwoven fabric having a base weight within the range of from 15 to 250 g/m$^2$.

6. A product as claimed in claim 5, characterised in that the bag is formed of a paper or nonwoven fabric having a base weight within the range of from 20 to 150 g/m$^2$.

7. A product as claimed in claim 1, characterised in that substantially all the sodium perborate is in monohydrate form.

8. A product as claimed in claim 1, characterised in that the activator for the perborate is a material which on reaction therewith generates peracetic acid.

9. A product as claimed in claim 8, characterised in that the activator for the perborate is tetracetyl ethylenediamine.

10. A product as claimed in claim 1, characterised in that the activator for the perborate is sodium octanoyloxybenzene sulphonate.

11. A product as claimed in claim 1, characterised in that the bleaching composition contains sodium perborate and activator in a weight ratio within the range of from 20:1 to 1:5.

12. A product as claimed in claim 11, characterised in that the bleaching composition contains sodium perborate and activator in a weight ratio within the range of from 3:1 to 0.8:1.

13. A product as claimed in claim 1, characterised in that the bag contains from 0.5 to 30 g of sodium perborate.

14. A bleach product as claimed in claim 13, characterised in that the bag contains from 1 to 15 g of sodium perborate.

15. A product as claimed in claim 1, characterised in that it contains from 10 to 40 g of total composition.

* * * * *

UNITED STATES PATENT AND TRADEMARK OFFICE

CERTIFICATE OF CORRECTION

PATENT NO. : 5,002,679

DATED : March 26, 1991

INVENTOR(S) : Tai

It is certified that error appears in the above—identified patent and that said Letters Patent is hereby corrected as shown below:

In claim 1, column 16, line 3, delete "it water permeable,".

Signed and Sealed this

Third Day of November, 1992

*Attest:*

DOUGLAS B. COMER

*Attesting Officer*

*Acting Commissioner of Patents and Trademarks*